US006357609B1

(12) United States Patent
Van Noord et al.

(10) Patent No.: US 6,357,609 B1
(45) Date of Patent: Mar. 19, 2002

(54) ADJUSTABLE DISPLAY SHELF

(75) Inventors: Andrew J. Van Noord, Caledonia; Gary L. White, Grand Rapids, both of MI (US)

(73) Assignee: Benmill, LLC, Grand Rapids, MI (US)

( * ) Notice: Subject to any disclaimer, the term of this patent is extended or adjusted under 35 U.S.C. 154(b) by 0 days.

(21) Appl. No.: 09/471,917

(22) Filed: Dec. 23, 1999

Related U.S. Application Data

(60) Provisional application No. 60/113,465, filed on Dec. 23, 1998.

(51) Int. Cl.[7] ..... A47B 46/00; A47F 5/08

(52) U.S. Cl. ..... 211/90.02; 211/90.03; 211/94.01; 248/292.14; 248/298.1; 248/241; 108/65

(58) Field of Search ..... 211/90.01, 90.02, 211/90.03, 94.01; 248/241, 298.1, 220.31, 225.11, 292.14, 225.21; 108/90, 93, 65, 107, 108; 312/205

(56) References Cited

U.S. PATENT DOCUMENTS 4,589,349 A * 5/1986 Gebhardt et al. ..... 211/132.1 X
4,646,658 A * 3/1987 Lee ..... 211/184 X
4,658,968 A * 4/1987 Mastrodicasa ..... 211/187
4,934,645 A * 6/1990 Breslow ..... 248/242
6,021,908 A * 2/2000 Mathews ..... 211/90.02
6,123,303 A * 9/2000 Huang ..... 211/90.02 X

* cited by examiner

*Primary Examiner*—Alvin Chin-Shue
*Assistant Examiner*—Erica B. Harris
(74) *Attorney, Agent, or Firm*—Waters & Morse, PC

(57) ABSTRACT

An adjustable depth shelf mechanism comprises a fixed shelf mountable on a vertical support mechanism, an adjustable shelf mounted on the fixed shelf for inward and outward movement on the fixed shelf to vary the depth of the shelf, and locking means for holding the adjustable shelf in one or more extended positions with respect to the fixed shelf. The shelves comprise wire mat product support surfaces mounted on shelf brackets. The wire mats include longitudinal wires on top of transverse wires. Downwardly extending notches are formed in the transverse wires of the fixed shelf at positions corresponding to the desired extended positions. The longitudinal wires of the adjustable mat fit into the notches when the adjustable mat is at the desired extended positions, such that the adjustable shelf mat lockingly nests in the fixed shelf mat and the shelves present a substantially coplanar upper surface. The shelves are connected together but are movable out of a locked coplanar relationship to permit inward and outward position adjustment of the shelves. Outwardly offset portions at rear ends of the fixed shelf brackets make it possible to mount two shelves end to end at the same level in one slot in the support member.

5 Claims, 5 Drawing Sheets

ADJUSTABLE DISPLAY SHELF

CROSS-REFERENCES TO RELATED APPLICATIONS

This is a continuation application of co-pending U.S. Provisional Patent Application Ser. No. 60/113,465, entitled Adjustable Display Shelf and filed on Dec. 23, 1998 by Andrew J. Van Noord, the disclosure of which is incorporated here by reference.

BACKGROUND OF THE INVENTION

1. Field of the Invention

The present invention relates to an adjustable display shelf for retail display of merchandise, wherein the depth of the display shelf can be adjusted to accommodate products of different sizes.

2. Description of Prior Art

It is customary for retailers to display merchandise on shelves that are hooked into slotted uprights mounted on a base. The shelves are frequently formed of a wire mat mounted on brackets that hook into the slotted uprights. The shelves are replaceable with shelves of different depths, depending upon the size of the product being mounted on the shelf. Shelves of different depths are usually stored in a warehouse when they are not being used.

A desirable feature of display shelves is to provide a waterfall or cascade effect, wherein the shelves become increasingly deeper from the top to the bottom of the upright support. This requires an inventory of a substantial number of shelves of different depths.

It is inconvenient and expensive to maintain a number of shelves of different depths and to change the shelves when products of different sizes are to be mounted on the shelves. This requires finding the shelves at the warehouse and exchanging the shelves for those presently in the display mechanism.

An object of the invention is to provide a single shelf having an adjustable depth, so that replacement of shelves is no longer required.

SUMMARY OF THE INVENTION

A shelf mechanism comprises one or more adjustable shelves mounted on one or more support members. The shelves include a fixed shelf mountable on the support mechanism, an adjustable shelf mounted on the fixed shelf for inward and outward movement on the fixed shelf to vary the depth of the shelf, and a locking mechanism for holding the adjustable shelf in one or more extended positions with respect to the fixed shelf.

The shelves include product support surfaces mounted on spaced shelf brackets, with the shelf brackets for the fixed shelf including connectors at rear ends that mate with connectors on the support members to support the shelf at a fixed elevation. The shelf brackets for the adjustable shelf are positioned adjacent to and attached to the shelf brackets for the fixed shelf for inward and outward movement with respect thereto. The shelves are constructed and connected such that upper surfaces of the fixed and adjustable shelves are substantially coplanar when the shelves are positioned in one or more of the extended positions, the shelves being held in the extended position when they are coplanar. The shelves are movable to non-coplanar positions wherein the relative extended positions of the shelves can be adjusted.

The shelves desirably comprise wire mat product support surfaces comprising spaced, interconnected longitudinal and transverse wires. Each wire mat has an upper surface that defines an upper plane, the mats fitting together at each extended position such that the upper planes of the shelves are coplanar.

In the preferred practice of the invention, the wire mats comprise longitudinal wires on top of transverse wires, the transverse wires of the fixed shelf comprising downwardly extending notches at positions corresponding to the desired extended positions, the longitudinal wires of the adjustable mat fitting into the notches when the adjustable mat is at the desired extended positions, such that the adjustable shelf mat lockingly nests in the fixed shelf mat and the shelves present a substantially coplanar upper surface. The shelves are connected together but are movable out of a locked coplanar relationship to permit inward and outward position adjustment of the shelves.

Another feature of the invention is that adjacent shelves can be mounted at the same elevation in the same mounting slot in a vertical support member. To accomplish this, shelf brackets for the fixed shelves include outwardly offset portions at rear ends that include hooks for mounting the shelf to the support member. The offset portions extend outwardly past the end of the shelf, so two shelves can be mounted together end to end in the same slot in the support member.

These and other features and advantages of the present invention are shown and described below in connection with a preferred embodiment of the present invention.

DETAILED DESCRIPTION OF THE PREFERRED EMBODIMENT

Figure 2:
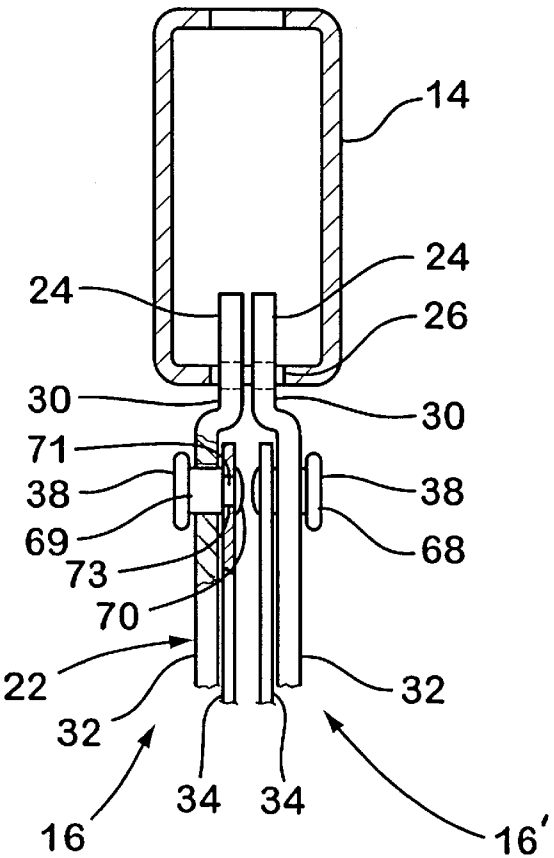
FIG. 2 is a fragmentary sectional view taken along line 2—2 of FIG. 1.
Figure 1:
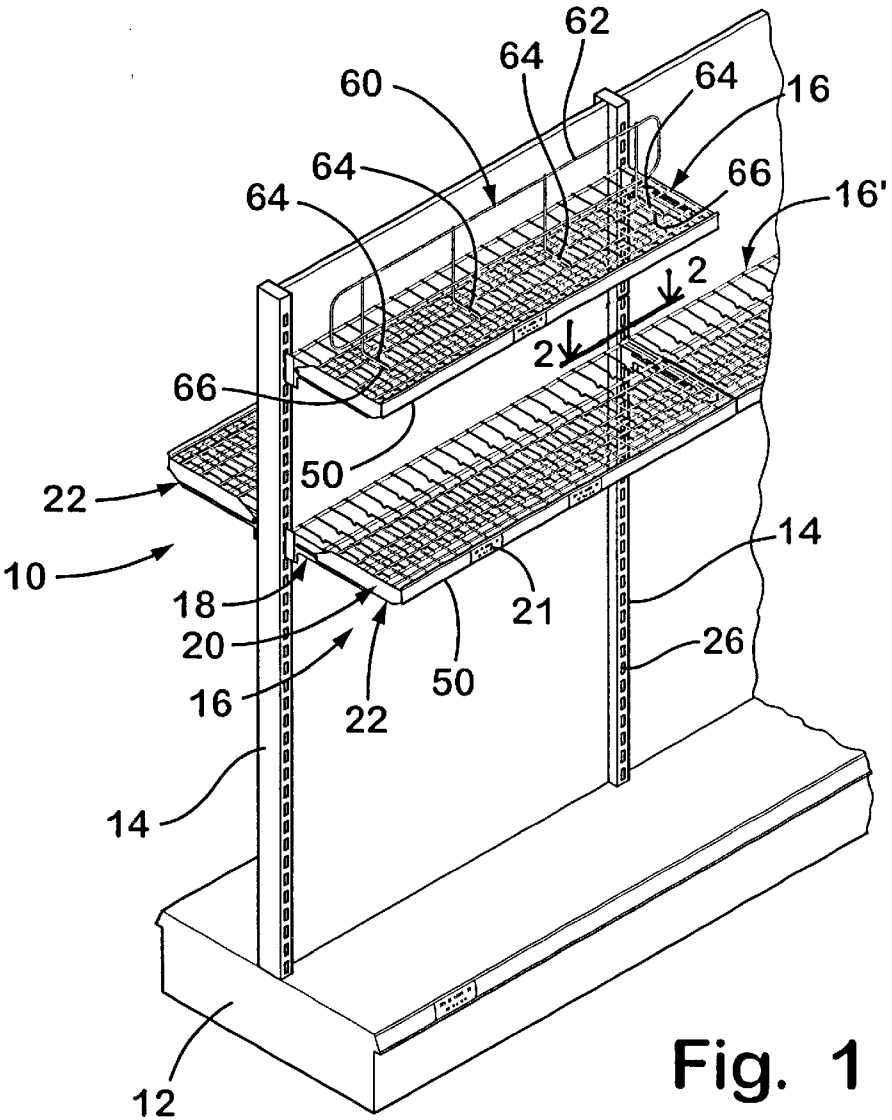
FIG. 1 is a perspective view of an adjustable display shelf in accordance with the present invention.

Referring to the drawings, a display rack 10, generally referred to as a gondola, comprises a base 12 with a plurality of slotted uprights 14 extending from the base at spaced locations along the base. Different retailers will require different upright spacing, which may vary between 30 and 48 inches or other dimensions.

One or more adjustable shelves 16 are mounted on the uprights for displaying merchandise. In accordance with the present invention, adjustable shelf 16 comprises a fixed position lower shelf 18 and an adjustable position upper shelf 20 movably mounted on lower shelf 18 to modify the depth of the shelf mechanism.

Lower shelf 18 comprises a shelf bracket 22 on each side of the shelf, with vertically spaced hooks 24 positioned at the rear edge of the shelf. The hooks fit into slots 26 spaced along uprights 14. Desirably, hooks 24 are positioned and aligned at a slight angle (preferably about 7°) from the vertical so the shelf is inclined slightly upwardly when mounted. The tilt backwards is intended to keep products on the shelves. A wire mat 28 extends between brackets 22 and provides the surface of the shelf. The wire mat is formed of spaced longitudinal wires 27 and transversely extending lateral or cross wires 29 welded together. The wire mat is welded to the bracket. The shelf could alternatively be formed of other types of shelf support surfaces.

Referring to FIG. 2, bracket 22 includes an offset portion 30 at an inner end which positions hooks 24 slightly outwardly from side panel 32 of the bracket.

Upper shelf 20 comprises a bracket 34 at each side of the shelf and a wire mat 36 interconnecting the brackets. Bracket 34 is slidably mounted in a slot 40 in bracket 22 by means of a rivet 38 that extends through the bracket 34. Bracket 34 pivots about the axis of rivet 38 to raise and lower the front portion of upper shelf 20, as shown in FIG. 4.

Wire mat 36 includes longitudinal wires 42 that run lengthwise between brackets 34 and lateral or cross wires 43, which are spot welded to the tops of the longitudinal wires 42.The longitudinal wires 42 are spaced a predetermined distance apart and are positioned to fit downwardly in V-shaped notches or indentations 44 in lateral or cross wires 29 of the lower shelf when the upper shelf is positioned horizontally. These notches make it possible for the upper wire mat to lie in the same plane as the lower wire mat when the upper shelf is positioned horizontally. The notches also provide for indexed position adjustments for the upper shelf with respect to the lower shelf. They also lock the upper shelf in place and prevent the upper shelf from sliding further out with respect to the lower shelf once the shelves are nested together in their desired positions. The notches also cause the shelves to be aligned in the same plane when they are in a load supporting position. The cross wires 43 of the upper shelf rest on the longitudinal wires 27 of the lower shelf when the shelves are nested together.

Figure 3:
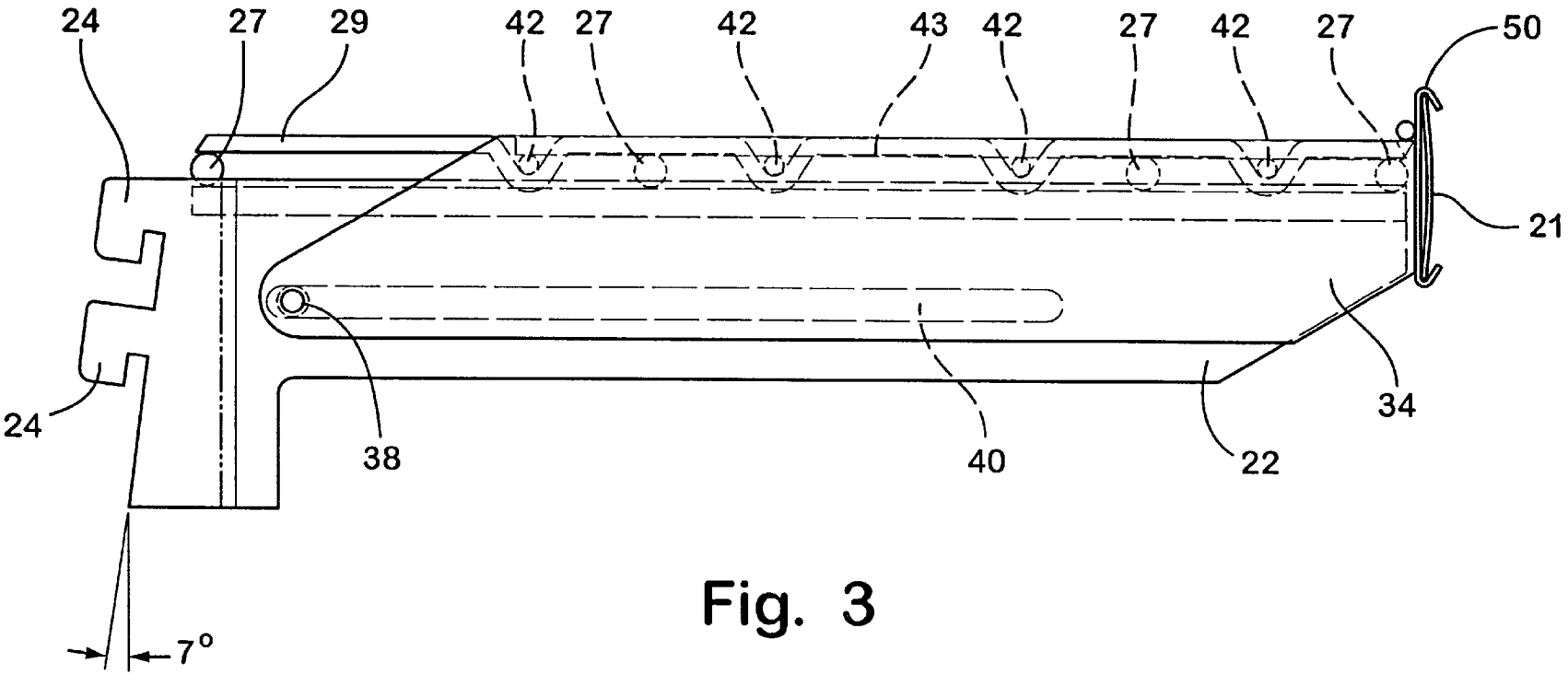
FIG. 3 is an end view of a display shelf, showing the adjustable shelf in its narrowest or retracted position.
Figure 4:
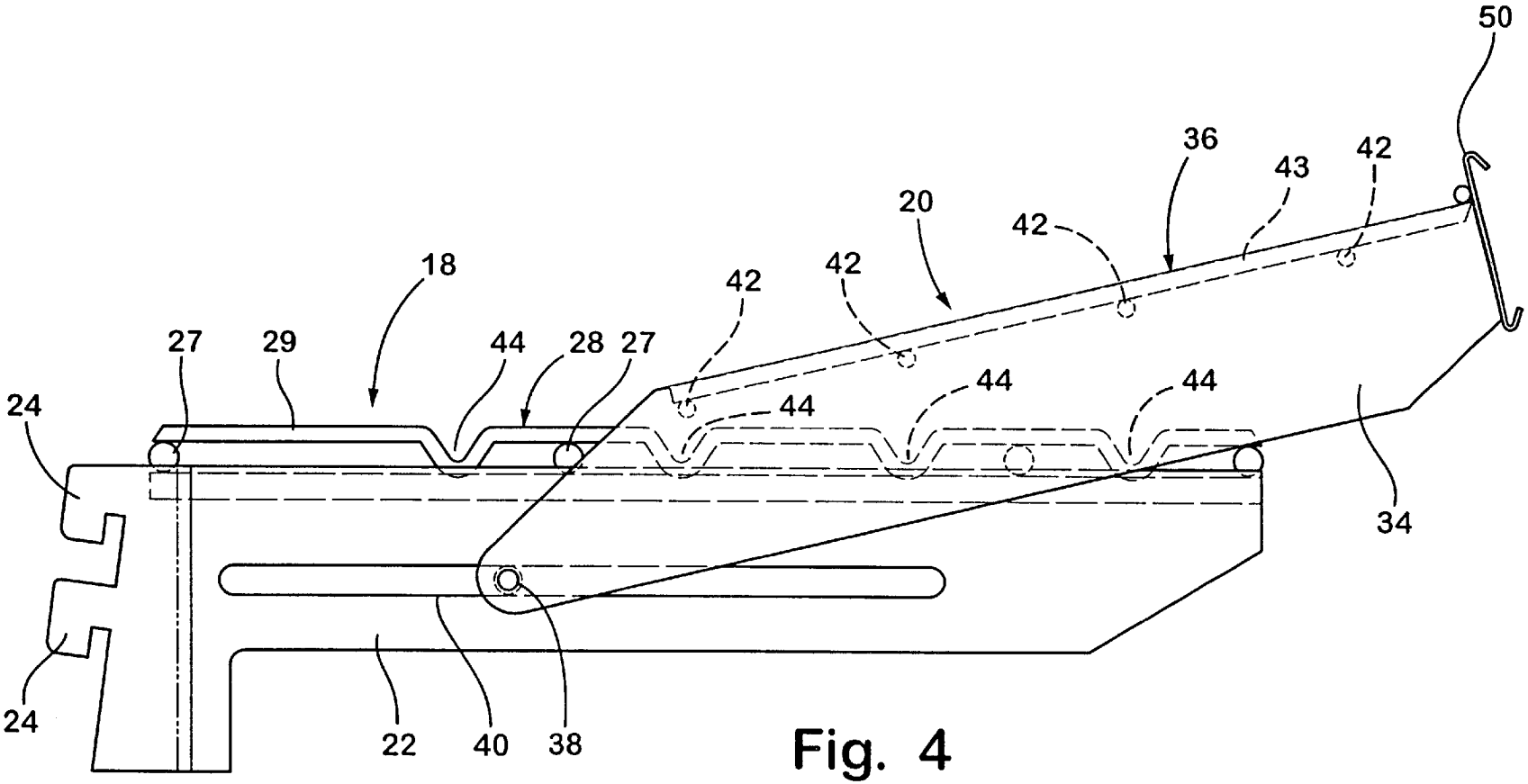
FIG. 4 is an end view of the shelf of FIG. 3, showing the adjustable shelf in an elevated position in the process of being adjusted.
Figure 5:
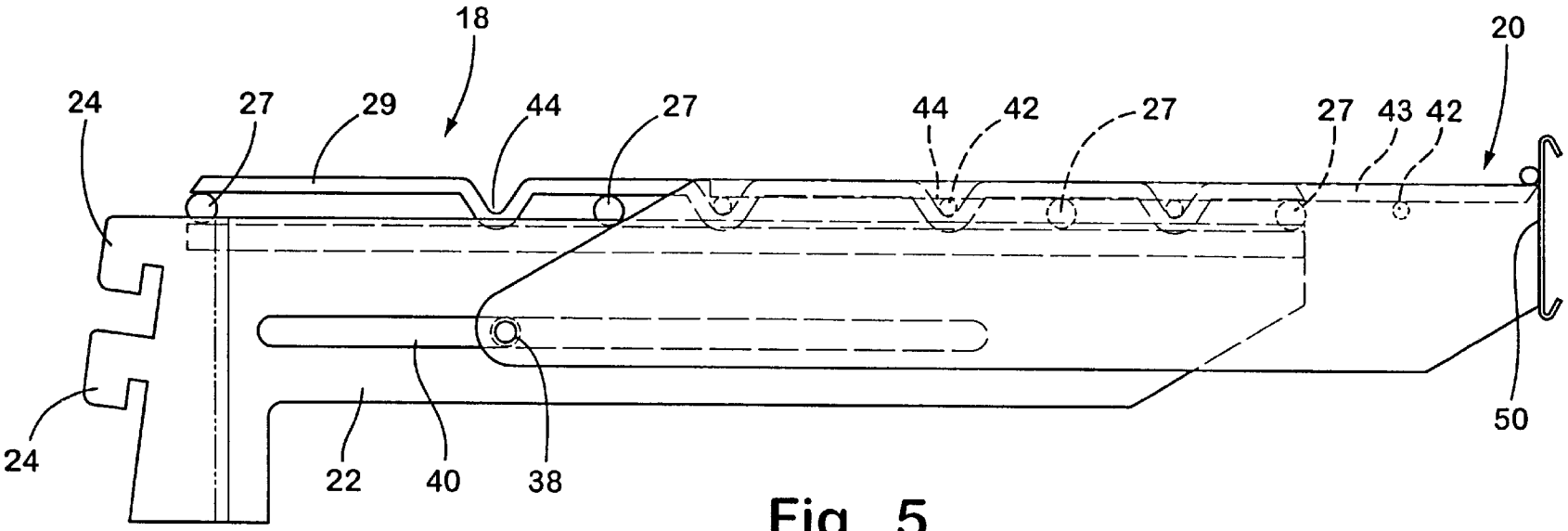
FIG. 5 is an end view of the shelf of FIG. 3 showing the adjustable shelf in an extended position.

The manner in which the depth of the shelves is adjusted is shown in FIGS. 3–5. The upper shelf is shown in the retracted position in FIG. 3. In order to adjust the position of the upper shelf with respect to the lower shelf, the upper shelf is pivoted upwardly, as shown in FIG. 4, and then slid out along slot 40 to a desired position wherein the wires 42 are positioned opposite the appropriate indentations 44 in the lateral or cross wires 29 of the lower bracket 22. The upper shelf is then pivoted downwardly into a locked position on the lower shelf, as shown in FIG. 5.

Another feature of the invention is that a ticket strip bracket 50 is mounted on the front edge of upper shelf 20. The ticket strip bracket comprises a C-shaped channel having an open front portion which can receive flexible signage 21 used for product identification, prices, advertising, or the like. Typically, the flexible signage is paper strips or plastic strips with writing on them of some sort. With the present invention, the ticket strip bracket is always positioned on the front edge of the upper shelf so that the ticket strip is always located at the front of the shelf regardless of whether the shelf is in an extended or retracted position.

Figure 6:
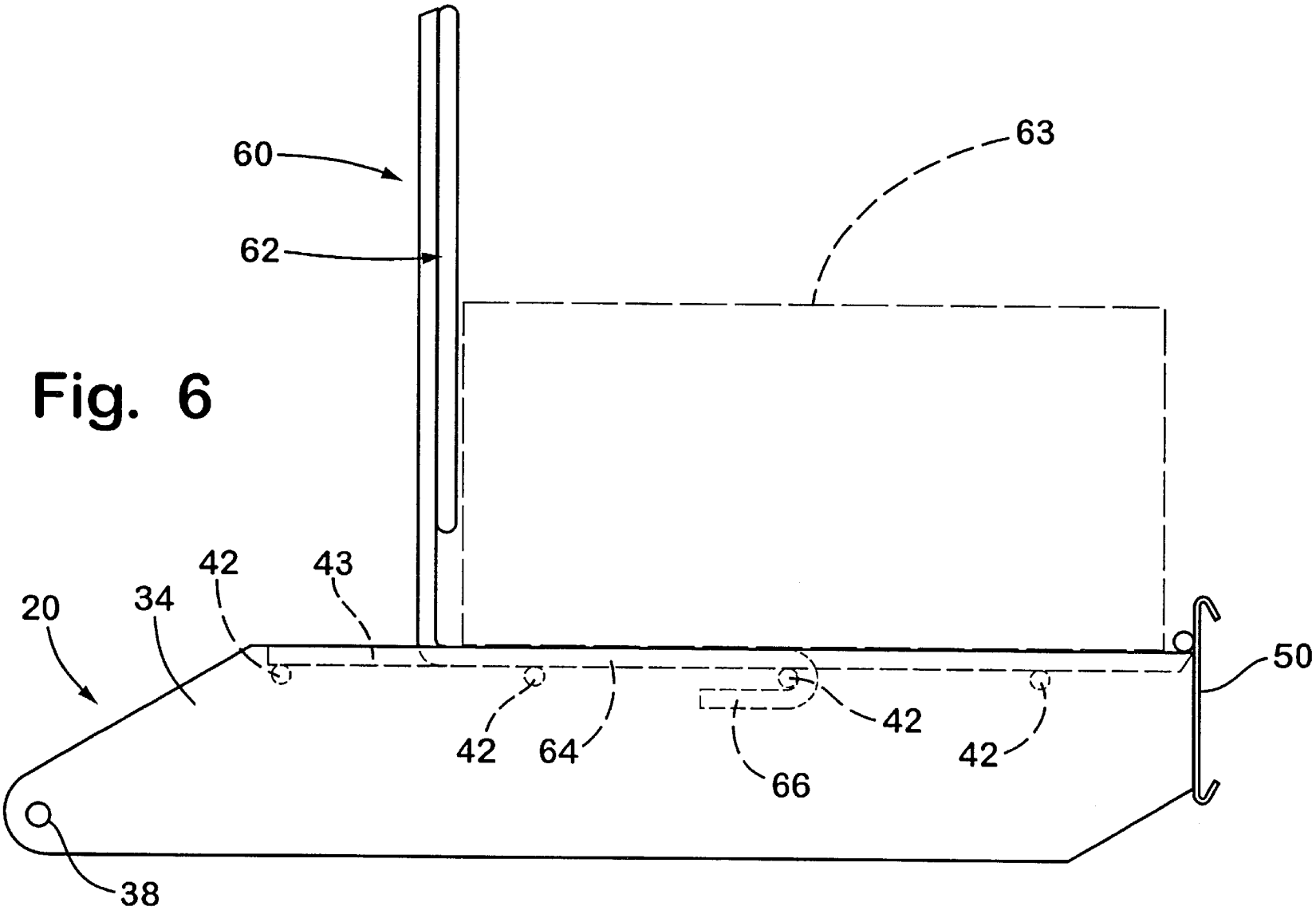
FIG. 6 is an end view of an adjustable shelf, showing an adjustable back rail attached thereto.

Another feature of the present invention is an adjustable fence 60 that can be installed on the shelves on any longitudinal wire, such as longitudinal wire 42 of the upper shelf, in order to create an adjustable position back member for any shelf. Fence 60 comprises a wire back member 62 that extends vertically from a plurality of horizontally positioned base members 64 that extend at right angles to longitudinal wires 42. Members 64 have downwardly and rearwardly facing C-shaped hooks 66 on front ends thereof. These hooks fit over longitudinal wires 42, and members 64 extend rearwardly therefrom and rest on the next adjacent longitudinal wire 42, thus holding back member 62 in a generally vertical position. The fence can be removed or repositioned forwardly or rearwardly on a different longitudinal wire in order to vary the depth of any particular shelf in order to accommodate a product 63 as shown in phantom in FIG. 6. This is accomplished simply by sliding the fence forwardly or outwardly until hooks 66 are disengaged from longitudinal wires 42. The fence can then be lifted up and repositioned on another longitudinal wire.

As shown in FIG. 2, when upper shelf 20 is mounted on lower shelf 18, bracket 34 lies immediately adjacent panel 32 of bracket 22 and fits generally in the space created by offset 30 in lower bracket 22. Rivet 38 interconnecting upper bracket 34 and lower bracket 22 has a head 68 on the inner side of bracket panel 32. A rivet shoulder 69 fits through the slotted opening 40 in panel 32 of lower bracket 22. A neck portion 71 of smaller diameter then extends through a round opening 73 in upper bracket 34. The rivet has a peened end 70 on the outer side of upper bracket 34. As shown in FIG. 2, the peened end also fits within the recessed space provided by portion 30 and does not extend outwardly past hook 24. This is significant because the hooks 24 of two horizontally adjacent shelf sections 16 and 16' can be mounted in the same slot 26, in order to mount the shelves at the same elevation in the support. The offset 30 in the shelf mechanism provides clearance space between the adjacent shelves when they are positioned side-by-side in this manner.

While the shelves of the present invention can be made any desired dimensions, in one preferred embodiment of the present invention, the shelves are 30 to 48 inches wide and lower shelf has a depth of approximately one foot and the upper shelf has a depth of approximately one foot, giving the shelf an adjustable depth of 12–22 inches. This is satisfactory for many purposes.

It should be understood that the foregoing is merely exemplary of the preferred practice of the present invention and that various changes and modifications can be made in the arrangements and details of construction of the embodiments disclosed herein without departing from the spirit and scope of the present invention.

What is claimed is:

1. A shelf mechanism wherein at least one shelf unit is mounted on at least one support member wherein the shelf unit is adjustable in depth, the shelf unit comprising:

a fixed shelf mountable on the support member;

an adjustable shelf mounted on the fixed shelf for inward and outward movement on the fixed shelf to vary the depth of the shelf unit; and locking means for holding the adjustable shelf in one or more extended positions with respect to the fixed shelf;

the shelves including product support surfaces mounted on spaced shelf brackets, the shelf brackets for the fixed shelf including connectors at rear ends that are formed so as to be matable with connectors on the support member to support the fixed shelf at a fixed elevation, the shelf brackets for the adjustable shelf being positioned adjacent to and attached to the shelf brackets for the fixed shelf for inward and outward movement with respect thereto, the shelves being constructed and connected such that upper surfaces of the fixed and adjustable shelves are substantially coplanar, such that the upper surfaces of the fixed and adjustable shelves are substantially parallel and are at elevations sufficiently close to each other that the fixed and adjustable shelves continue to effectively present a single shelf surface when the shelves are positioned in one or more of the extended positions, the adjustable shelf being held in said extended position the fixed and adjustable shelves are substantially coplanar,the shelves being movable to non-coplanar positions wherein the relative extended positions of the shelves can be adjusted.

2. A shelf mechanism according to claim 1 wherein the adjustable shelf is mounted on the fixed shelf by means of projections on the adjustable shelf brackets that ride in longitudinal slots in the fixed shelf brackets, the adjustable shelf having an adjustment position, wherein the upper surfaces of the adjustable and fixed shelves are not coplanar and are extendable with respect to each other, the shelves not being coplanar when they are in position wherein such inward and outward position adjustment is possible.

3. A shelf mechanism wherein at least one shelf unit is mounted on at least one support member wherein the shelf unit is adjustable in depth, the shelf unit comprising:

a fixed shelf mountable on the support member;

an adjustable shelf mounted on the fixed shelf for inward and outward movement on the fixed shelf to vary the depth of the shelf unit; and locking means for holding the adjustable shelf in one or more extended positions with respect to the fixed shelf;

the shelves comprising wire mat product support surfaces comprising spaced, interconnected longitudinal and transverse wires, each wire mat having an upper surface that defines an upper plane, the mats fitting together at each extended position such that the upper planes of the shelves are sufficiently coplanar that the fixed and adjustable shelves effectively present a single shelf surface when the shelves are in one or more of the extended positions.

4. A shelf mechanism according to claim 3 wherein the wire mats comprise longitudinal wires on top of transverse wires, the transverse wires of the fixed shelf comprising downwardly extending notches at positions corresponding to the desired extended positions, the longitudinal wires of the adjustable mat fitting into the notches when the adjustable mat is at the desired extended positions, such that the adjustable shelf mat lockingly nests in the fixed shelf mat and the shelves present a substantially coplanar upper surface, wherein the upper surfaces of the fixed and adjustable shelves are substantially parallel and are at elevations sufficiently close to each other that the shelves continue to effectively present a single shelf surface when the shelves are in one or more of their extended positions, the shelves being connected together but being movable out of a locked coplanar relationship to permit inward and outward position adjustment of the shelves.

5. A shelf mechanism comprising a support member and at least one shelf unit is removably mounted on the support member, wherein the shelf unit is adjustable in depth, the shelf unit comprising:

a fixed shelf mountable on the support member;

an adjustable shelf mounted on the fixed shelf for inward and outward movement on the fixed shelf to vary the depth of the shelf unit; and locking means for holding the adjustable shelf in one or more extended positions with respect to the fixed shelf;

the shelves including product support surfaces mounted on spaced shelf brackets, the shelf brackets for the fixed shelf including connectors at rear ends that mate with connectors on the support member to support the fixed shelf at a fixed elevation, the shelf brackets for the adjustable shelf being positioned adjacent to and attached to the shelf brackets for the fixed shelf for inward and outward movement with respect thereto, the shelves being constructed and connected such that upper surfaces of the fixed and adjustable shelves are substantially coplanar, such that the upper surfaces of the shelves are substantially parallel and are at elevations sufficiently close to each other that the shelves continue to effectively present a single shelf surface when the shelves are positioned in one or more of the extended positions, the shelves being held in said extended position when the fixed and adjustable shelves are substantially coplanar, the shelves being movable to non-coplanar positions wherein the relative extended positions of the shelves can be adjusted;

each fixed shelf comprising a support surface mounted on spaced fixed shelf brackets positioned substantially at longitudinal ends of the shelves, the fixed shelf brackets including an outwardly offset portion at a rear end that extends longitudinally past the end of the shelf, the offset portion including one or more hooks that fit in slots in vertical support members for fixing the fixed shelf at a desired vertical position, the slots being at least twice as wide as the hooks, the offset portions making it possible to mount two shelves end to end at the same level on one slot in the support member.

* * * * *